US006060695A

United States Patent [19]

Härle et al.

[11] Patent Number: 6,060,695

[45] **Date of Patent: *May 9, 2000**

[54] ELECTRICALLY HEATED SCISSORS WITH CUTTING BLADE OF EACH LIMB COMPRISING ELECTRIC HEATING LAYER OR INSERT

[75] Inventors: Günther Härle; Volker Heiss, both of Tuttlingen, Germany

[73] Assignee: Josef Heiss Medizintechnik GmbH, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/881,570

[22] Filed: Jun. 24, 1997

[30] Foreign Application Priority Data

Jun. 28, 1996 [DE] Germany ..... 196 26 069
Nov. 8, 1996 [DE] Germany ..... 196 46 190

[51] Int. Cl.[7] ..... B26B 13/00

[52] U.S. Cl. ..... 219/229; 219/227; 30/140; 606/174; 606/28

[58] Field of Search ..... 219/228, 227, 219/240, 241, 242, 250, 251, 229; 30/140; 606/174, 175, 167, 27–29

[56] References Cited

U.S. PATENT DOCUMENTS

| | | | |
|---|---|---|---|
| 1,834,555 | 12/1931 | Tittle | 30/140 |
| 2,032,688 | 3/1936 | Dart | 219/228 |
| 2,421,125 | 5/1947 | Krebs | 30/140 |
| 3,391,690 | 7/1968 | Armao | 30/140 |
| 4,198,957 | 4/1980 | Cage et al. . | |
| 4,702,246 | 10/1987 | Ellis et al. . | |
| 5,046,251 | 9/1991 | Scott | 30/140 |
| 5,309,640 | 5/1994 | Caron | 30/140 |
| 5,484,436 | 1/1996 | Eggers et al. . | |
| 5,743,017 | 4/1998 | Dreher et al. | 219/229 |
| 5,792,137 | 8/1998 | Carr et al. | 606/29 |
| 5,827,281 | 10/1998 | Levin | 606/51 |

FOREIGN PATENT DOCUMENTS

| | | |
|---|---|---|
| 538 306 | 4/1993 | European Pat. Off. . |
| 2 407 797 | 6/1979 | France . |
| 2 407 797 | 7/1979 | France . |
| 495365 | 4/1930 | Germany . |
| 295 06 308 U | 4/1995 | Germany . |
| 296 17 177 U | 12/1996 | Germany . |
| 296 18 309 U | 12/1996 | Germany . |
| 296 18 310 U | 12/1996 | Germany . |
| 295 06 308 U | 1/1997 | Germany . |
| 296 18 310 U | 1/1997 | Germany . |
| 1-274375 | 11/1989 | Japan . |
| 3-102409 | 10/1991 | Japan . |
| 5-324101 | 12/1993 | Japan . |
| 92/00688 | 1/1992 | WIPO . |

OTHER PUBLICATIONS

Stevenson, Lang, D.: "Combined Diathermy Forceps And Scissors In:", The Lancet, vol. II (1959), pp. 650, 651.

*Primary Examiner*—John A. Jeffery
*Attorney, Agent, or Firm*—Wolf, Greenfield & Sacks, P.C.

[57] ABSTRACT

A pair of electrically heatable scissors includes two pivotally connected limbs and a current supply. Each of the limbs has a handle region and a cutting region. A blade of at least one of the limbs is formed from an electrically heatable layer or insert that is electrically connected to the current supply. Alternatively, the limbs may be formed in the cutting zone of a single material that can be locally electrically heated when supplied with an electrical current. Scissors of this type are simpler and more effective than scissors that have limbs heated by electrical resistors.

13 Claims, 8 Drawing Sheets

A 4:1

ELECTRICALLY HEATED SCISSORS WITH CUTTING BLADE OF EACH LIMB COMPRISING ELECTRIC HEATING LAYER OR INSERT

FIELD OF THE INVENTION

The present invention relates to an electrically heatable pair of scissors having two limbs, which are pivotally connected and respectively have a handle region and a cutting region, and a current supply.

BACKGROUND OF THE INVENTION

A pair of scissors of this kind is known from EP 0 538 306 B1. In these scissors a heating resistance is accommodated in a recess of each limb, with the heating resistances in the two limbs being electrically connected together in series.

OBJECT OF THE INVENTION

It is the object of the present invention to make a pair of scissors of the initially named kind simpler, but at the same time more effective.

SUMMARY OF THE INVENTION

The solution of this object takes place in accordance with a first embodiment in that at least one of the limbs has as a blade an electrically heatable layer or insert which is electrically connected to the current supply. Thus, in accordance with the invention, an electrically heatable layer or insert is used as the blade and is directly heated by the supply of current. Thus, in accordance with the invention, no foreign heating is required because the blade itself forms the heated body. This results in the great advantage that the heat arises directly and only in the cutting edge (and not in the whole area of the blade), whereby substantially less energy has to be used than if the whole cutting region had to be heated. Since actually only the cutting edge is heated, the remaining region of the blade of each limb remains substantially cooler than the cutting edge so that the danger of burns is precluded.

In an alternative embodiment the limbs consist, at least in the cutting edge region, of a single material which is electrically heatable and electrically connected to the current supply. It has surprisingly been found that a direct current heating of the cutting edge region is possible, whereby any form of foreign heating can be omitted because the cutting edge itself forms the heating body. Moreover, in this variant no form of inserts or additional layer is required, whereby a very simple manufacture is possible. Through the use of a steel with a high melting point and by a corresponding control of the current flowing through the limbs, spark formation can be reduced and the premature aging of the material can be precluded.

Advantageous embodiments of the invention are described in the specification, the drawings and the subordinate claims.

Thus, the layer or insert can be supplied with current in such a way that the heating current flows substantially parallel to the respective limb. In this way the heating takes place over the entire length of the blade.

In accordance with a further embodiment of the invention the layer or insert can be provided at both limbs, with two layers or inserts being capable of being supplied with current in such a way that the heating current flows via the shearing point of the scissors between the two layers or inserts. In this embodiment only the instantaneous shearing point of the scissors which is formed by the contact of the two blades is heated. The two blades thus close the current circuit, with heat being liberated point-wise at the location at which it is required by the potential drop between the two layers or inserts.

In accordance with a further embodiment of the invention the limbs can consist of a material whose electrical and/or thermal conductivity is lower than that of the layer or of the insert, which, for example, consists of steel. In this way the heat development can be restricted to the region of the cutting edges. However, the limbs of the scissors outside of the cutting edges do not heat up or only heat up to a small degree. In this way, any danger of burns is precluded. At the same time the energy requirement is substantially reduced, because only a very restricted volume has to be heated. Provision can also be made for the layer or insert to be electrically and/or thermally completely insulated relative to the associated limb.

In accordance with a further design of the invention, the two limbs can be supplied with current in such a way that the heating current flows between the two limbs via the shearing point of the scissors. In this embodiment only the instantaneous shearing point of the scissors which is formed by the contact of the two limbs is heated. The two blades thus close the current circuit, with heat being set free point-wise at the position at which it is required by the potential drop between the two layers or inserts.

The current supply for the scissors can be arranged in the handle region of one limb, with an electrically conductive spring contact being located at this limb and communicating with a contact in the handle region of the other limb. In this way a sliding contact is formed between the two handle regions, by which the current can be conducted.

In accordance with an alternative embodiment the current supply can be arranged in the handle region of one limb, at which an electrically conductive flat strip cable is located. This flat strip cable is connected to the handle region of the other limb and has at the center of the scissors a flexion or kink point. In this way the scissors can be actuated in the customary manner, with the flexible flat strip cable remaining between the handle region of the scissors without it being disturbing.

The blades of the invention can either be applied as a thin layer to the respective limb or can be formed as an insert which is worked into one limb and projects out of the latter somewhat in the region of the cutting edge.

In accordance with a further embodiment of the invention the element which produces the connection between the two limbs can be electrically insulated. In this way a situation is avoided in which a short circuit current flows via the connection of the two limbs should the scissors be completely manufactured of electrically conductive material. In this respect it is particularly advantageous when the region of each limb surrounding the element is electrically insulated since then it is ensured that no electrical short circuit is produced in the region of pivot on actuation of the scissors.

Alternatively, each limb can consist in the handle region of insulating material and can be manufactured of electrically conductive material in the cutting region, with the connection between the two limbs being arranged in the insulated region. In this case an electrically conductive element can also be used.

In accordance with a further aspect of the present invention the latter relates to a power supply for a pair of scissors, the power supply having a current control device which restricts the start-up current flowing between the limbs. Through a power supply of this kind it is possible to prevent spark formation in that the start-up current increases from a low value to a high value after each interruption of the current, for example through complete opening of the scissors or through jamming of the material to be cut between the limbs.

BRIEF DESCRIPTION OF THE DRAWINGS

In the following the invention will be described purely by way of example with reference to an advantageous embodiment and to the accompanying drawings. There are shown:

FIGS. 11 and 11A illustrate a pair of electrically heatable scissors in use to coagulate a blood vessel.

DETAILED DESCRIPTION OF PREFERRED EMBODIMENTS

Figure 1A:
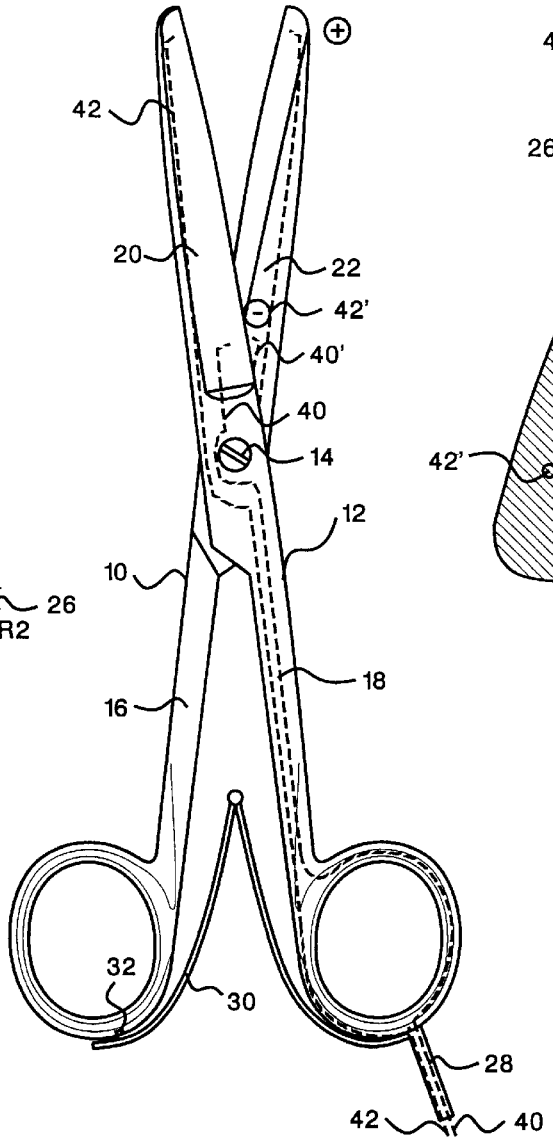
FIG. 1A is a first embodiment of an electrically heatable pair of scissors
Figure 1B:
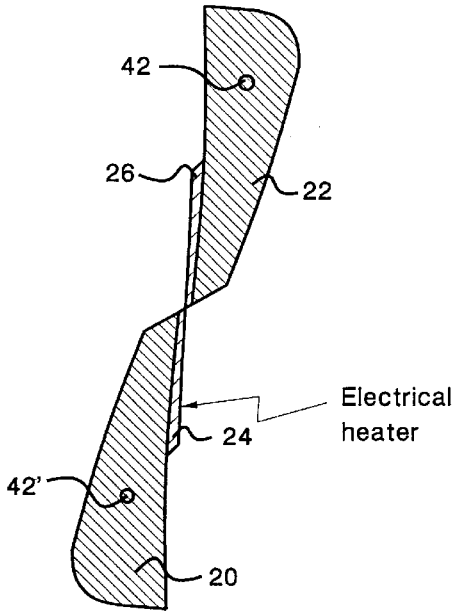
FIG. 1B is a cross-sectional view of the electrically heatable pair of scissors of FIG. 1A.
Figure 1C:
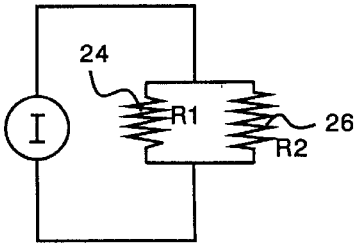
FIG. 1C is a schematic diagram illustrating the electrical connections of the embodiment of FIG. 1A.

FIG. 1 shows a first design of an electrically heatable pair of scissors, having two limbs 10, 12 which are pivotally connected together via a screw 14 and which respectively have a handle region 16, 18 and a blade region 20, 22. The handle region 16, 18 of each limb 10, 12 has a finger opening in the customary manner. A current supply 28 is secured in the lower region of the finger opening of the limb 12.

The cross-sectional view of FIG. 1 shows a section through the blade regions 20 and 22 at the instantaneous shearing point of the scissors. As can be readily recognized, a respective electrically heatable layer 24, 26 is provided on the two limbs 10, 12 as the actual cutting edge. The actual cut is thus not carried out by the blade regions 20, 22 of the limbs 10, 12 but rather by the layers 24, 26 which serve as the cutting edges.

In the embodiment in FIG. 1 the two layers 24, 26 are supplied with current in such a way that the heating current flows substantially parallel to the respective limb 10, 12. The current conduction between a current supply 28 and the two limbs 24, 26 hereby takes place through lines 40,42 and 40',42' arranged in the interior of the limbs and which contact the layers 24 and 26 adjacent the pivot 14 and at the tip of the blade respectively. Thus, a potential drop arises at each of the limbs and is indicated for the limb 10 by way of example with "+" and "−".

For the further conduction of the electrical heating current from the current supply 28, which is secured to the limb 12, to the limb 10 electrically conductive spring contacts 30 (only one shown) are located in the handle region 18 of the limb 12 and are in electrically conductive communication with further contacts 32 (also only one shown) at the lower end of the handle region 16 of the limb 10. On actuation of the scissors the ends of the spring contacts 30 thus slidingly contact the contacts 32 of the limb 10 and in this way supply the lines 40', 42' provided in the limb 10. As can be readily seen from FIG. 1, the spring contact is of kinked design at the center of the scissors and resiliently spreads on opening of the scissors.

Figure 2A:
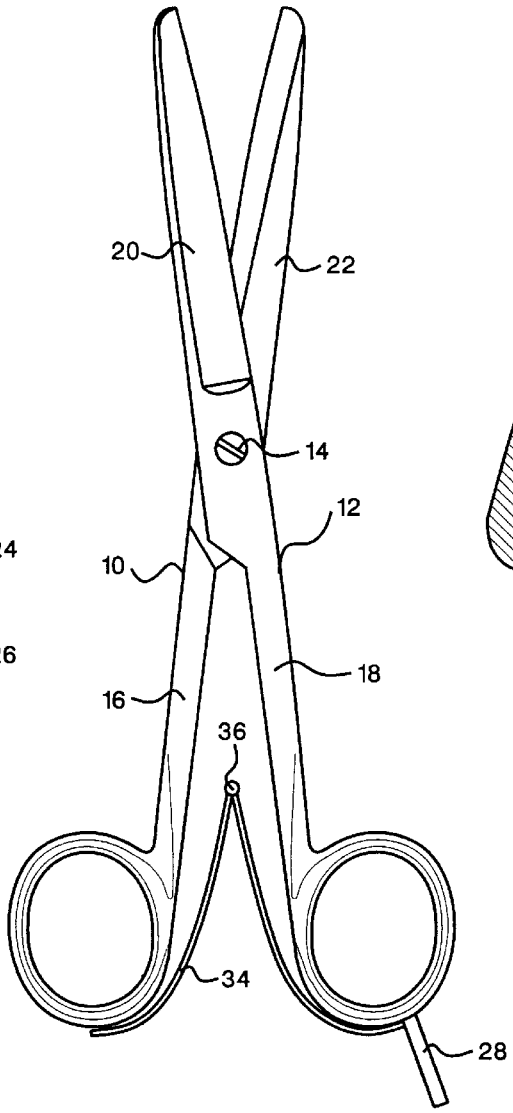
FIG. 2A is a second embodiment of an electrically heatable pair of scissors.
Figure 2B:
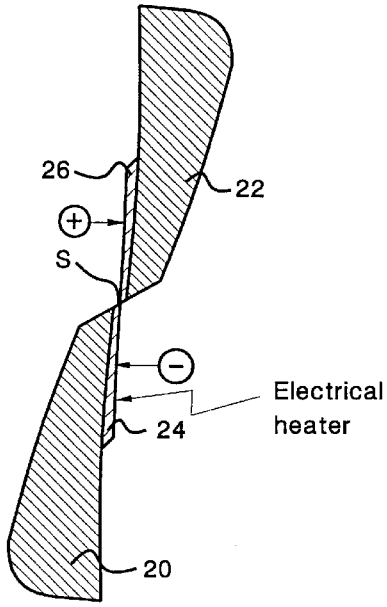
FIG. 2B is a cross-sectional view of the electrically heatable pair of scissors of FIG. 2A.
Figure 2C:
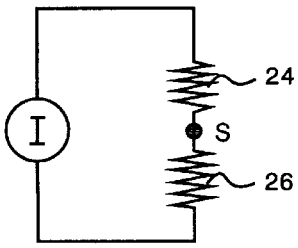
FIG. 2C is a schematic diagram illustrating the electrical connections of the embodiment of FIG. 2A.

FIG. 2 shows a second embodiment of an electrically heatable pair of scissors which is similar in construction to the scissors shown in FIG. 1. Accordingly, the same reference numerals are used for the same parts.

The scissors shown in FIG. 2 likewise have two layers 24, 26 which respectively serve as cutting edges and which are respectively mounted on a limb 10, 12. In this embodiment these two layers 24, 26 are, however, so supplied with current that the heating current flows via the shearing point S between the two layers 24, 26. For example, it is indicated in FIG. 2 that the layer 26 is located at the positive potential and the layer 24 at the negative potential.

In the embodiment shown in FIG. 2 the electrical current is directed from the current supply 28 to the layers 24 and 26 through the basic body of the scissors. The two limbs 10, 12 are mutually electrically insulated in this arrangement. An electrically conductive flat strip cable 34 is secured in the handle region 18 of the limb 12 and is connected to the handle region 16 of the other limb 10. The flat strip cable 34 is of symmetrical design and has a flexion point 36 at the center of the scissors. In this way the scissors can be actuated in the customary manner, with the flat strip cable arranged between the two handle regions not exerting any disturbing influence.

Figure 3A:
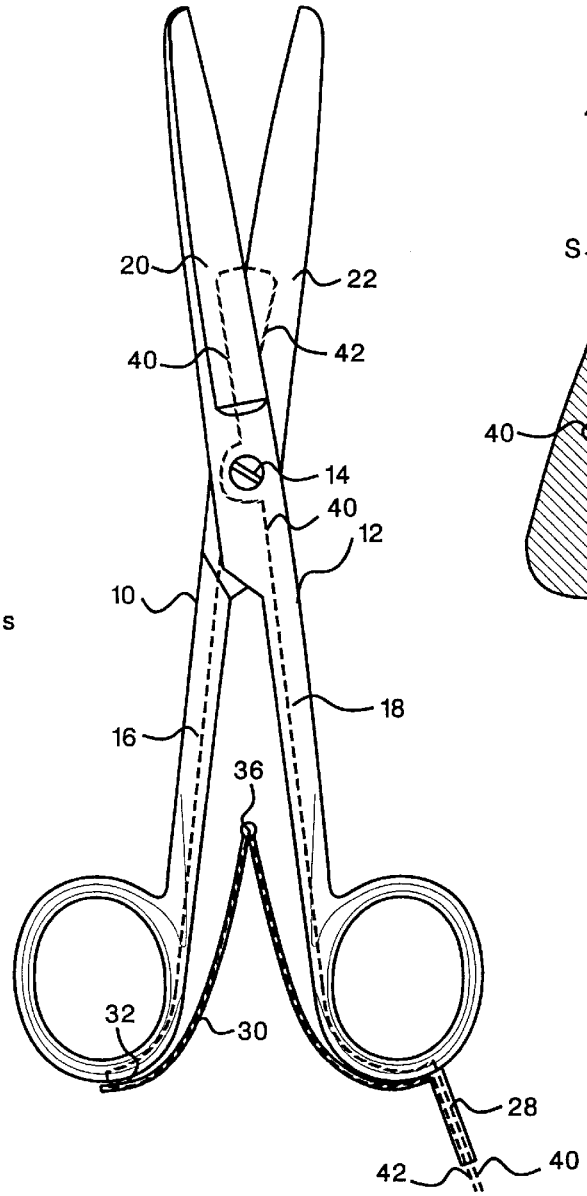
FIG. 3A is a third embodiment of an electrically heatable pair of scissors.
Figure 3B:
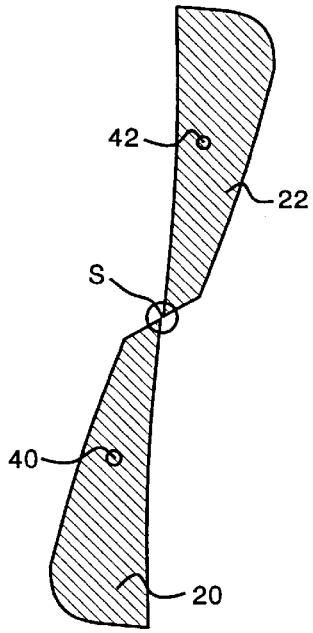
FIG. 3B is a cross-sectional view of the electrically heatable pair of scissors of FIG. 3A.
Figure 3C:
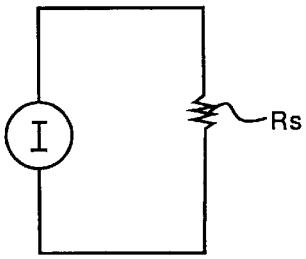
FIG. 3C is a schematic diagram illustrating the electrical connections of the embodiment of FIG. 3A.
Figure 4:
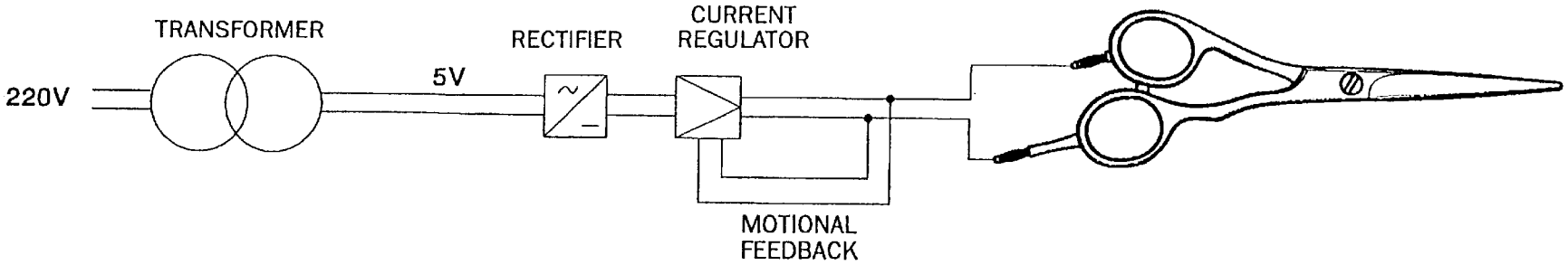
FIG. 4 is an electronic schematic diagram of a power supply for use with the electrically heatable pair of scissors.
Figure 5:
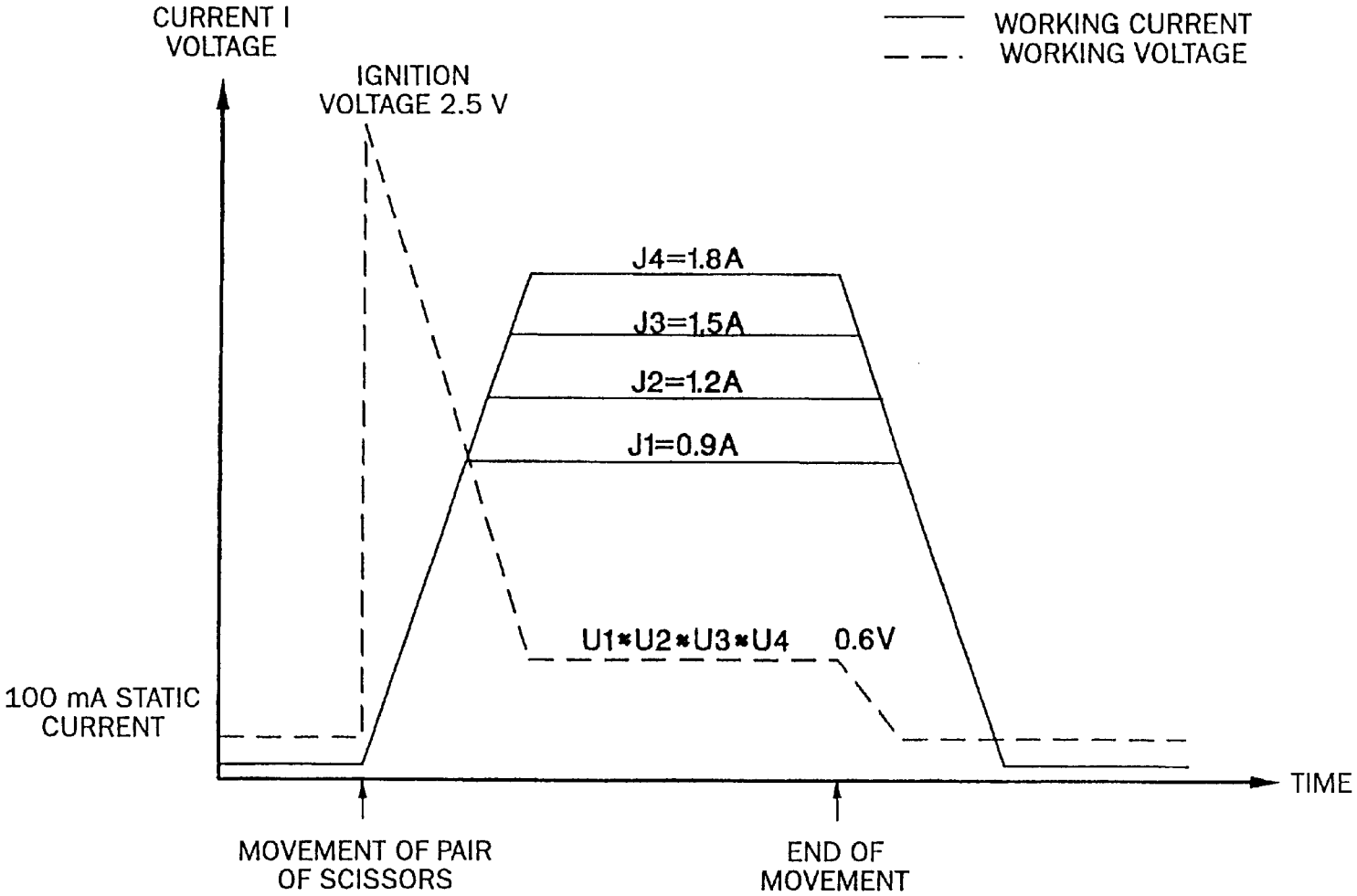
FIG. 5 is a graph of current vs. time clearly showing the current at start-up being restricted.
Figure 8:
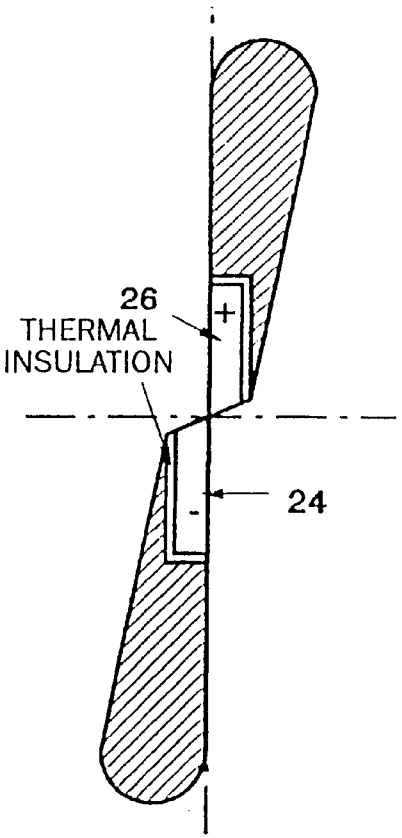
FIG. 8 is a cross-sectional view of a cutting region of an electrically heatable pair of scissors containing an insulation layer between the scissors and the electrically heatable insert.
Figure 7:
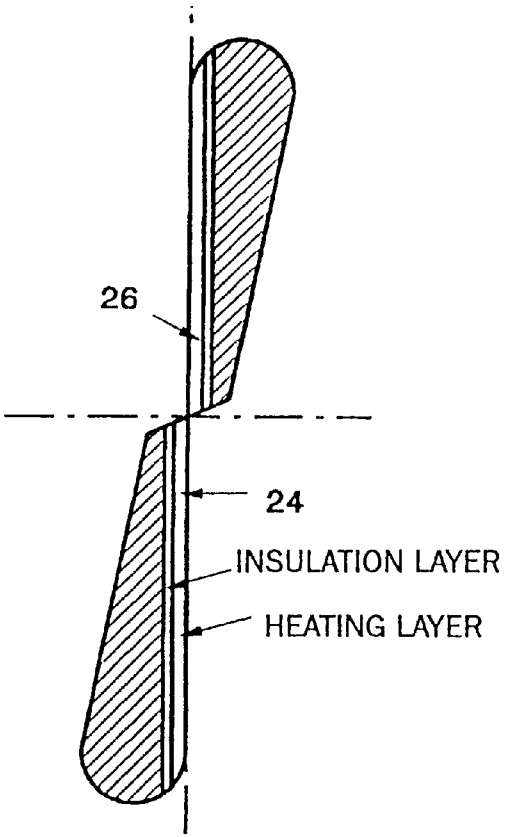
FIG. 7 is a cross-sectional view of a cutting region of an electrically heatable pair of scissors containing an insulation layer between the scissors and the heating layer.
Figure 6:
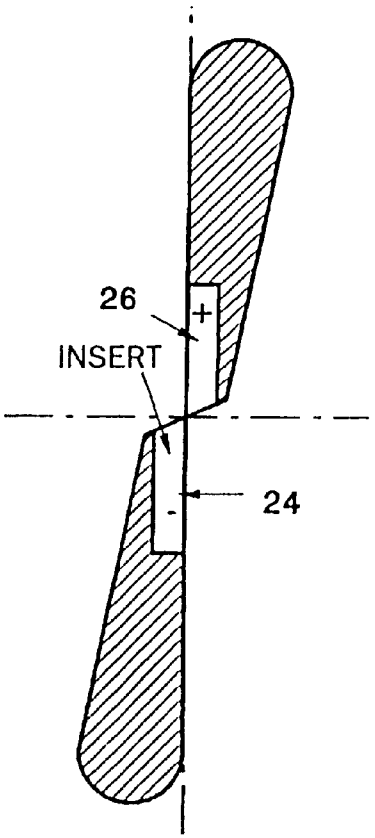
FIG. 6 is a cross-sectional view of a cutting region of an electrically heatable pair of scissors containing an electrically heatable insert.
Figure 9:
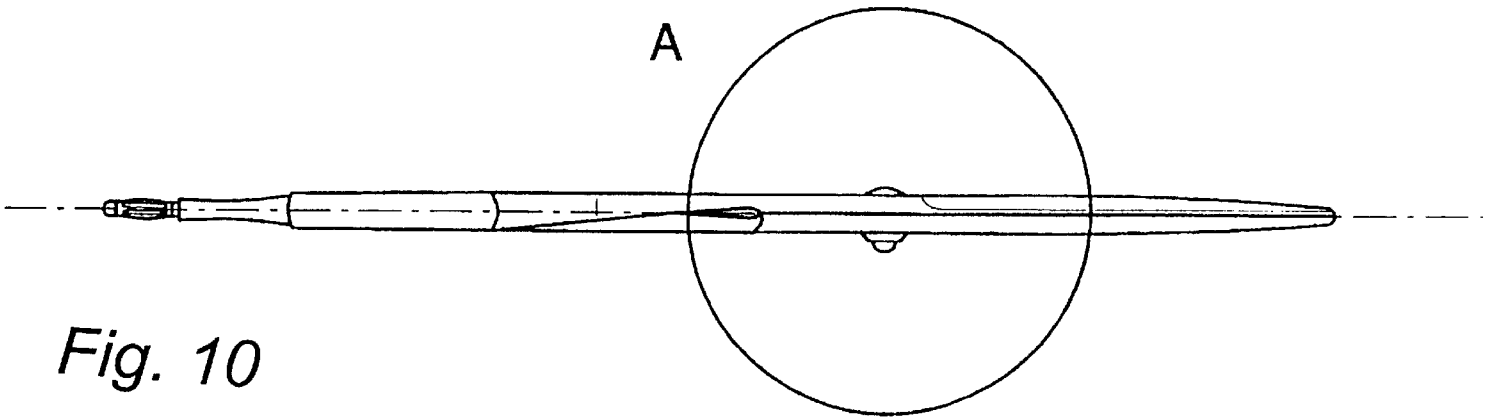
FIG. 9 is a top view of the scissors showing where detail section "A" is taken.
Figure 10:
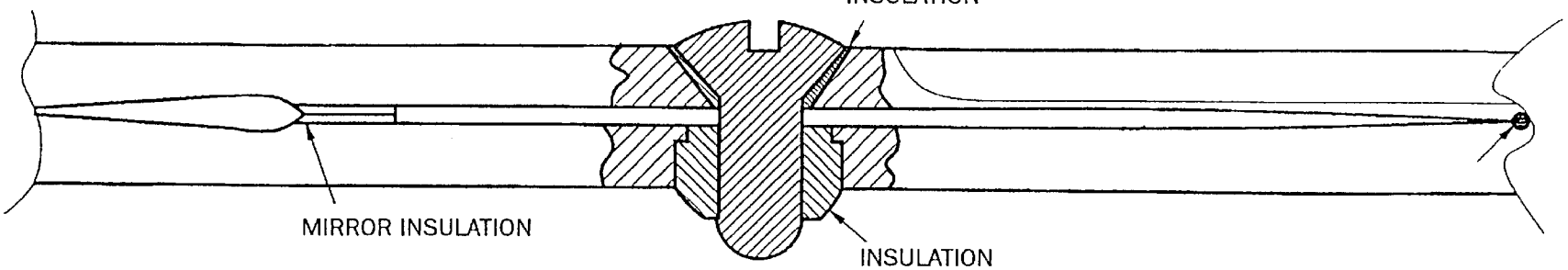
FIG. 10 is a cross-sectional view depicting a structure for electrically isolating limbs of a pair of electrically heatable scissors.
Figure 11:
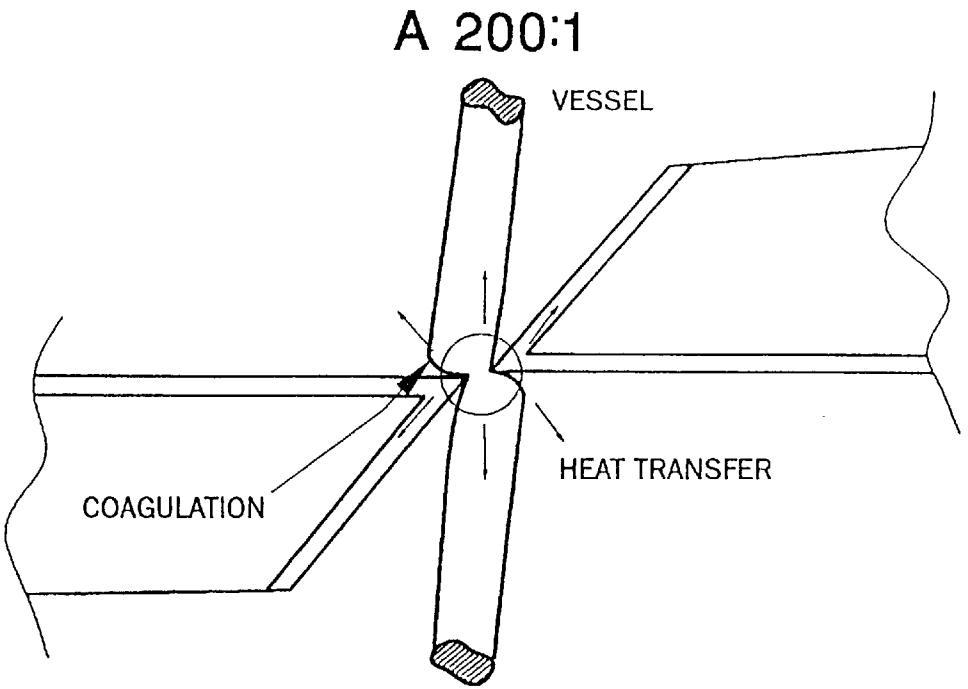
Figure 11:
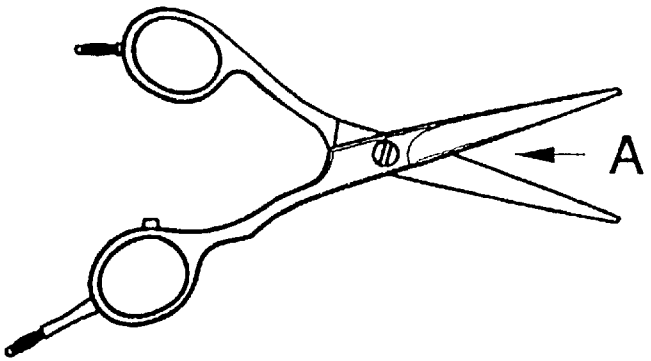

FIG. 3 shows an alternative embodiment of an electrically heatable pair of scissors with two limbs 10, 12 which are pivotally connected via a screw 14, and which respectively have a handle region 16, 18 and a blade region 20, 22. The handle region 16, 18 of each limb 10, 12 has a finger opening in the customary manner. A current supply 28 is secured in the lower region of the finger opening of the limb 12.

The cross-sectional view in FIG. 3 shows a section through the blade regions 20 and 22 at the instantaneous shearing point S of the scissors. As can be readily recognized, the two limbs each consist of a single material, such as is the case with a customary pair of scissors. The material is a steel with a high melting point, and the material can also be provided with surface refinement for certain applications. The two limbs can be insulated from one another in the same way as in the embodiment of FIG. 2.

In the illustrated embodiment the two cutting regions 20, 22 are supplied with current in such a way that the heating current flows substantially parallel to the respective limb 10, 12. The current conduction between the current supply 28 and the two blade regions 20, 22 hereby takes place through lines 40,42 which are illustrated in broken lines and are arranged in the interior of the limbs. Thus, the heating current flows between the two limbs 10 and 12 at the shearing point S.

For the further conduction of the electrical heating current from the current supply 28, which is secured to the limb 12, to the limb 10 an electrically conductive spring contact 30 is located at the handle region 18 of the limb 12 and stands in electrically conductive communication with a further contact 32 at the lower end of the handle region 16 of the limb 10. On actuation of the scissors the end of the spring contact 30 thus slidingly contacts the contact 32 of the limb 10. As can be readily seen from FIG. 3 the spring contact is of kinked design at the center of the scissors and spreads resiliently on opening of the scissors.

An electrically conductive flat strip cable can also be secured in the handle region 18 of the limb 12, with the cable being connected to the handle region 16 of the other limb 10. The flat strip cable can be symmetrically designed and can have a flexion point at the center of the scissors. In this way the scissors can be actuated in the customary manner with the flat strip cable arranged between the two handle regions not exerting any disturbing influence.

A power supply is provided for the operation of the pair of scissors of the invention and has a current control device which restricts the start-up current flowing between the limbs. An "intelligent" power supply of this kind ensures that after closing of the current circuit, i.e. contact of the blade regions 20, 22 of the limbs 10, 12 no sudden current rise occurs. In this way spark formation and thus damage to the blade material is prevented. The start-up current which arises after each renewed closing of the current circuit is so controlled in the power supply that it rises to a desired end value within a predetermined time duration.

Through the use of the above described pair of scissors with the power supply of the invention, good results can be achieved because no spark formation occurs but nevertheless an effective sealing of hairs is possible (i.e., the hair is not simply cut, as it is by using a cold pair of scissors, rather the surface is somewhat sealed or melted).

The power supply can be designed for DC current, AC current and also for high-frequency AC current.

The scissors of the invention can also be used extremely advantageously in the medical field in addition to their use for cutting hair. Only bipolar tweezers have hitherto been used for the purpose of coagulating tissue or vessels. When using such tweezers the current however flows from one end of the tweezers through the tissue to be coagulated into the other end of the tweezers. During this the ends of the tweezers do not heat up substantially and therefore heating, and thus a coagulation, only occurs in the tissue. By using the scissors of the invention for the coagulation the advantage however arises that the coagulation of the tissue takes place by the heated scissor blades and the current flow through the tissue is minimised. The scissors of the invention can be used for the coagulation of vessels and of tissue of a general kind. Use is possible both in the microsurgical field and also in the field of general surgery.

What is claimed is:

1. Electrically heatable scissors, comprising:

two limbs, each of said limbs having a handle region configured to be grasped by a user and a cutting region, said two limbs being pivotally connected at a pivot point located, on each limb, between the respective handle region and the respective cutting region; and an electrical current supply;

said limbs being electrically connected to said electrical current supply such that the current can flow through one of the limbs to the instantaneous shearing point of the scissors and via the shearing point into the other limb, the shearing point being formed by the point-like contact of the two limbs and heat being generated in the limbs point-wise at the shearing point.

2. Apparatus in accordance with claim 1, wherein the electrical current supply is arranged in the handle region of a limb on which an electrically conductive spring contact is located, said spring contact communicating with a contact in the handle region of the other limb.

3. Apparatus in accordance with claim 1, wherein the electrical current supply is connected to the handle region of one of said limbs at a location corresponding to a location at which an electrically conducive flat strip cable is located, said electrically conductive flat strip cable being connected to the handle region of the other of said limbs and comprising at least one of a flexion and a kink point near the center of the scissors.

4. Apparatus in accordance with claim 1, wherein an element that produces the connection between the two limbs is electrically insulated.

5. Apparatus in accordance with claim 1, wherein a region of each limb surrounding an element that produces the connection between the two limbs is electrically insulated.

6. Apparatus in accordance with claim 1 wherein the cutting zone is at least one of electrically and thermally insulated relative to the handle region.

7. The electrically heatable scissors of claim 1, further comprising:

two layers made of an electrically conductive material and disposed one on each limb, each layer forming the blade of the respective cutting region and extending parallel to the respective limb, and the layers being electrically connected to said electrical current supply such that the current can flow through one of the layers to the shearing point of the scissors and via the shearing point into the other layer.

8. Apparatus in accordance with claim 7, wherein at least one of said limbs comprises a material exhibiting at least one of an electrical and thermal conductivity smaller than the material comprising the layer.

9. Apparatus in accordance with claim 7, wherein the layer is at least one of electrically and thermally insulated relative to the associated limb.

10. The electrically heatable scissors of claim 1, further comprising:

two inserts made of an electrically conductive material, each insert being disposed in a recess of the respective limb, and each insert forming the blade of the respective cutting region and extending parallel to the respective limb, and the inserts being electrically connected to said electrical current supply such that the current can flow through one of said inserts to the shearing point of the scissors and via the shearing point into the other insert.

11. Apparatus in accordance with claim 10, wherein at least one of said limbs comprises a material exhibiting at least one of an electrical and thermal conductivity smaller than the material comprising the insert.

12. Apparatus in accordance with claim 10, wherein the insert is at least one of electrically and thermally insulated relative to the associated limb.

13. The electrically heatable scissors of claim 1, wherein the limbs comprise, at least in the cutting region, a single material that is electrically heatable and that is electrically connected to the electrical current supply.

* * * * *